US005598678A

United States Patent [19]

Reynolds

[11] Patent Number: 5,598,678

[45] Date of Patent: Feb. 4, 1997

[54] CEILING DEVICES

[76] Inventor: Henry B. Reynolds, 6517 Millwood Rd., Bethesda, Md. 20817

[21] Appl. No.: 481,070

[22] Filed: Jun. 7, 1995

[51] Int. Cl.[6] ..... E04B 2/00

[52] U.S. Cl. ..... 52/506.09; 248/231.81; 248/317; 248/320; 52/509

[58] Field of Search ..... 52/39, 712, 506.08, 52/506.09, 506.1, 509, 733.2, 733.3, 737.6; 248/231.81, 317, 320

[56] References Cited

U.S. PATENT DOCUMENTS

| | | | |
|---|---|---|---|
| 3,005,293 | 10/1961 | Hunter | 52/712 X |
| 3,672,112 | 6/1972 | Sions et al. | 52/712 |
| 3,981,116 | 9/1976 | Reed | 52/506.1 |
| 4,245,446 | 1/1981 | Judkins | 52/506.08 X |
| 4,257,205 | 3/1981 | Kuhr | 52/506.08 |
| 4,297,824 | 11/1981 | Ricci | 52/712 X |
| 4,466,225 | 8/1984 | Hovind | 52/733.3 X |
| 4,858,409 | 8/1989 | Handley et al. | 52/506.09 |
| 5,311,719 | 5/1994 | Jahn | 52/506.09 |

*Primary Examiner*—Lanna Mai
*Attorney, Agent, or Firm*—William G. Rhines, Esq.

[57] ABSTRACT

Devices for ceilings in which tiles are supported by a concealed suspension grid include channels and channel hangers that establish the ceiling level and support the suspension grid and, together with wall supports form the suspension grid. Each channel, in cross-section, is substantially "U" shaped and has a retaining tab portion positioned at one end of one of its legs that is oriented at right angles to that leg in the direction of the other leg. The tabbed leg may be shorter than the untabbed leg which may be substantially the same height as the depth of the edge grooves in the ceiling tiles. Each hanger is adapted for affixation to a support structure at one end, and has a channel-receiving aperture at its other end whose height when said hanger is vertically oriented is greater than the height of the retaining tab portion of the channels, and has a vertical slot in its floor that is deeper than the height of the retaining tab. With the channel oriented so that it opens laterally toward said hanger, the untabbed leg of the channel may be positioned in the edge slot of ceiling tiles positioned adjacent to the bottom end of the hanger while the other (tabbed) end of the channel is slid into the aperture in the hanger, until the tab drops into the slot in the floor of the aperture, locking the channel and the ceiling tiles into position.

4 Claims, 1 Drawing Sheet

CEILING DEVICES

BACKGROUND OF INVENTION

In the field of building construction, it is a common practice to install hung ceilings in new or existing structures. Various alternative structural systems and methods are used for hanging a support frame at the approximate level of the desired ceiling and then affixing tiles, panels or the like to the support frame. Such frames typically are formed from channels which, in cross section, are in the shape of a "T", an "I", or other known per se shape. They may be made from aluminum, steel, plastic or other materials that are suitable for the intended use. The tiles, panels and other surfacing materials commonly are made from cellulose, plastic, glass, and other appropriate materials.

Many such ceiling systems are known and in common use. However, many have shortcomings and difficulties that make them difficult to install, unattractive, or otherwise unacceptable in varying degrees. These difficulties were enumerated, elaborated upon, addressed and traversed by the invention disclosed in my U.S. Pat. No. 5,081,812 (issued Jan. 21, 1992) and U.S. Pat. No. 5,177,929 (issued Jan. 12, 1993).

In connection with the foregoing, reference is made to the following U.S. Pat. Nos.: 4696141, 4760671, 4089146, 4169340, 3841048, 3942561, 3863413, 3988871, 3983116, 3995823, 3998020, 3798419, 3640042, 3708941, 3714753, 3742674, 2994112, 2996765, 3004644, 3093548, 3070851, 334465, 2406771, 1578964, 2101952, 2389171, 2725127, 2963751, 3302355, 3375630, 3981116, 3767008, 3775929, 3977144, 4275541, and 4991370, and Canadian Patent #576180.

Further research and development in this field has resulted in structures for the hangers and channels that differ from those disclosed in my said Patents which provide improved positional stability of the hung ceiling tiles that is advantageous in certain situations. These innovations are otherwise direct replacements for the corresponding constituents in the structures and (mutatis mutandis) methods which form the subject matter of my said issued U.S. Patents.

Accordingly, it is an object of this invention to provide means for installing ceiling materials.

It is a further object to provide means for achieving the foregoing purpose by which a support structure may be perfected that is concealed.

A further object is to provide means for achieving the foregoing objectives in which the need is eliminated for adjustable supports, shims, furring strips, moveable hangers, and other distance modifiers for causing the support frame to be positioned in a flat planar orientation.

Still another object of this invention is to provide means for achieving the foregoing objectives wherein the support means includes means for establishing the planar position of the ceiling system.

Yet another object is to provide means for achieving the foregoing objectives wherein the ceiling materials are installed with improved positional stability.

SUMMARY OF THE INVENTION

Desired objectives may be achieved through practice of the present invention which relates to hanger and channel devices for use in ceilings in which tiles are supported by a suspension grid that is not visible from the underside of the ceiling. Embodiments comprise channels and channel hangers that establish the ceiling level and also support the suspension grid in its mid-span regions and, together with wall supports for supporting the ceiling where the grid abuts the walls, form the suspension grid as a whole. Each channel, in cross-section, is substantially "U" shaped and has a retaining tab portion positioned at the outermost end of one of its legs that is oriented at right angles to that leg in the direction of the other leg. In preferred embodiments, the tabbed leg is shorter than the untabbed leg, and the latter is substantially the same height as the depth of the edge grooves in ceiling tiles the channel is to support. Each hanger is adapted for affixation to a support structure, such as a ceiling joist, and has a channel-receiving aperture at its other end whose height when said hanger is vertically oriented is greater than the height of the retaining tab portion of the channel to be inserted into it, and has a vertical slot in its floor that is deeper than the height of the retaining tab. By those means, with the channel oriented so that it opens laterally toward said hanger, the untabbed leg of the channel may be positioned in the edge slot of at least one ceiling tile positioned adjacent to the bottom end of the hanger while the other (retaining tab) end of the channel is slid into the aperture in the hanger, until the retaining tab drops into the slot in the floor of the aperture, thus locking into position the channel and the ceiling tiles located in proximity to said hanger into the edge grooves of which said untabbed leg of said channel is inserted.

DESCRIPTION OF DRAWINGS

This invention may be understood from the description which follows and from the accompanying drawings in which.

DESCRIPTION OF PREFERRED EMBODIMENTS

Figure 1:
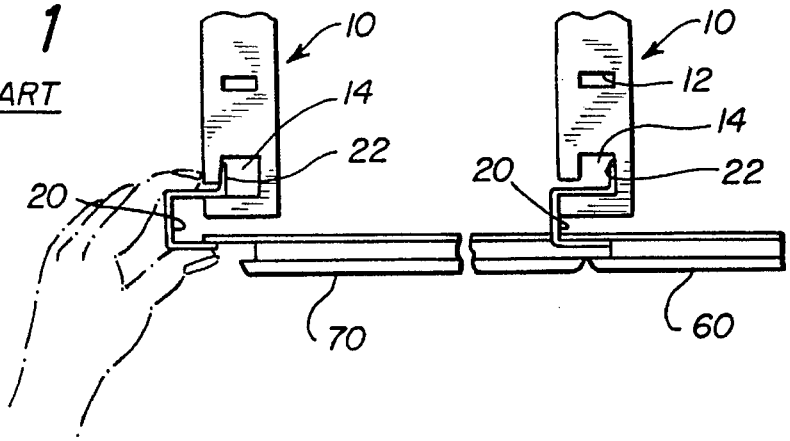
FIG. 1 PRIOR ART
FIG. 1 is a side view of prior art hanger structures.

Referring first to FIG. 1, there is depicted prior art ceiling tile hanger structures as disclosed in my prior U.S. Pat. Nos. 5,081,812 and 5,177,929. They include hangers 10 that may be affixed at one end to rafters, previously installed ceilings, or other basic support structures, with the other end hanging down more or less vertically at a level established, for example, in accordance with the teachings of my said Patents. In FIG. 1, the right-hand portion depicts a hanger 10 and elongated channel 22 that have been so installed, with a tile 60 fastened thereto by the retaining tabbed leg of the "U" shaped channel 20 residing in the hanger aperture 14. The tab portion 22 of the channel 20 abuts the back wall of the aperture 14 and, since the tab is longer than the height of the aperture where it opens through the side of the hanger, the tab prevents the channel from sliding to the left and out of the aperture. The left-hand portion of the depiction in FIG. 1 shows the same type of arrangement during the course of the channel 20 being installed onto tile 60, after the channel has been tilted upward to enable the tab to clear the aperture opening and before the channel has been moved into the aperture 14 sufficiently for its tab 22 to abut the back wall of the aperture 14. Subsequently, the edge tongue of a ceiling tile may be inserted into the left-hand groove of the tile 70 to hold it in place, in the same manner as shown to have been done with the tongue on the right-hand edge of the tile 70 with respect to the groove in the left-hand edge of the tile 60. While this approach is efficacious for many installations, there is still the possibility that the channel may move laterally to the extent of the width of the aperture, and that can result in misalignment and/or release of tiles until the last tile in a wall-to-wall row is positioned snugly in place.

Figure 2:
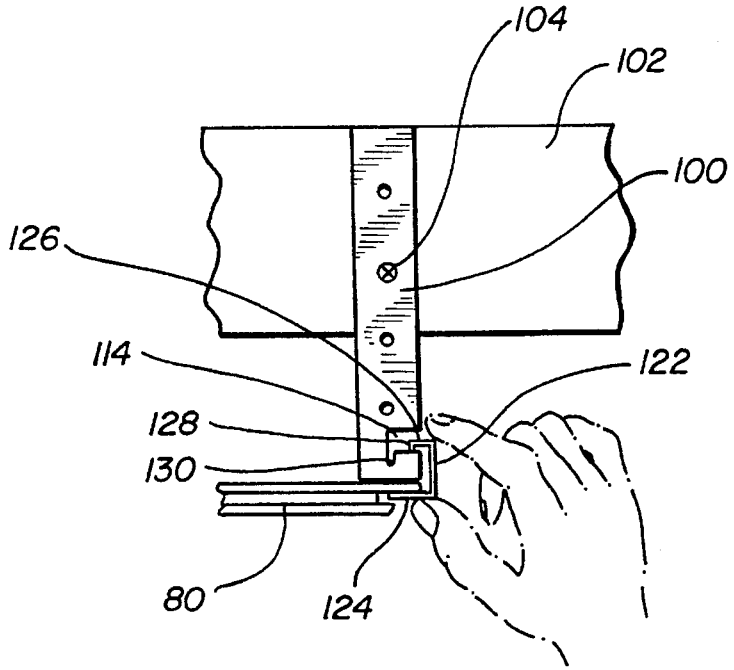
FIG. 2 is a side view of a channel structure useful in practicing the present invention.
Figure 3:
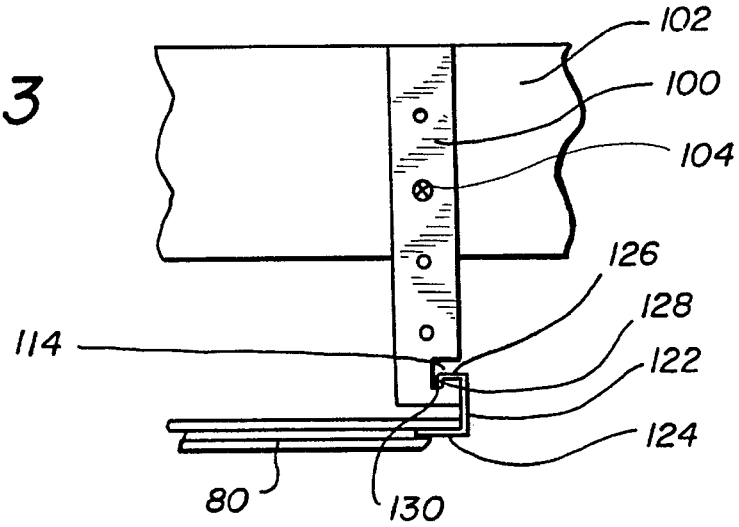
FIG. 3 is another side view of the embodiment of this invention illustrated in FIG. 2.

The embodiments of this invention shown in FIGS. 2 and 3 avoid such difficulties, and ensure that channels once placed in position and their associated tiles are not subject to such movements. These embodiments include elongated channels 122 and channel hangers 100 that establish the ceiling level and also support the suspension grid in its mid-span regions and, together with wall supports for supporting the ceiling where the grid abuts the walls, form the suspension grid as a whole. Each channel, in cross-section, is substantially "U" shaped, preferably with one leg 124 longer than the other to enable it to occupy as fully as possible the depth of the edge groove of a ceiling tile 80 to be secured thereby. Thus being "substantially" (as hereinafter defined) "U" shaped, its actual configuration may vary therefrom but still function in substantially in the same way and substantially to the same effect as the exact configuration herein being discussed for illustration purposes. The other, preferably shorter, leg 126 of the channel 122 having a retaining tab portion 128 at its outermost end that is oriented at right angles to the leg 126 and in the direction therefrom of the leg 124. Each hanger has means, such as holes, at one end by means of which fastening devices, such as screws 104 may be used to affix the hanger to structural support members such as the ceiling joists 102. Each channel also has a channel-receiving aperture 114 at its opposite end whose height is greater than that of the retaining tab 128 portion of the channel 122 to be inserted into it. The aperture 114 has a vertical slot 130 in its floor that is deeper than the height of the retaining tab 124, and preferably is located substantially at the juncture of the bottom and back wall of the aperture 114. By those means, with the channel 122, oriented so that it opens laterally (i.e., as illustrated, to the left), the untabbed leg 124 of the channel may be positioned in the edge slot of a ceiling tile 80 positioned adjacent to the bottom end of the hanger 100 while the retaining tab end of the other channel leg 126 is slid through the opening of and into the aperture 114, until the retaining tab 128 drops into the slot 130 in the floor of the aperture, thus locking the channel and the ceiling tile into position. FIG. 2 shows this sequence before completion, and FIG. 3 shows it after completion. When this sequence is completed and these elements are so positioned, the channel is prevented from moving laterally out of the aperture except as desired and implemented by lifting. Further, the tile into the edge groove of which the other (longer) leg of the channel has been inserted will not be moveable laterally so long as that channel remains in place, provided that other leg is sufficiently long to occupy substantially all of the tile edge groove. In that connection as well as in the entire context of this invention, the term "substantially" as used herein is intended to mean that although the condition or state of affairs to which that term refers is not or may not be literally totally so, any variance therefrom does not materially adversely affect the desired effect what would result but for that variance.

It will be seen from the foregoing that through practice of this invention, it is possible to construct a tile ceiling and its associated grid with assurance of positional stability of the tiles throughout the construction thereof as well as after completion, and that the principles of this invention may be embodied in a wide range of variants from the exact forms and/or configurations of the various elements hereinbefore described and illustrated.

Accordingly, it is to be understood that the embodiments of this invention herein illustrated and discussed are by way of illustration and not of limitation, and that a wide variety of embodiments may be made without departing from the spirit or scope of this invention.

I claim:

1. Cooperatively interacting channel hanger and channel devices, for use in ceilings in which tiles that have edge grooves of established depth are supported by a suspension grid that is not visible from the underside of the ceiling, that establish the ceiling level and support the suspension grid in its mid-span regions and, together with wall supports for supporting the ceiling where the grid abuts the walls, form the suspension grid as a whole, said hanger and channel devices comprising at least one elongated channel which is substantially "U" shaped in cross-section; said channel having an untabbed leg, and a tab-bearing leg with a retaining tab portion positioned at substantially a right article to the outermost end toward said untabbed leg, and which channel is suspended from at least one hanger that is affixed to a support structure at one of its ends and has a channel-receiving aperture at its other end, which aperture has a floor positioned toward said other end with a vertical slot therein, such that said tab-bearing leg is inserted into said aperture and said retaining tab portion resides in said slot, the vertical height of said aperture when said hanger is vertically oriented being greater than the height of said retaining tab portion of said channel and the depth of said vertical slot being greater than is the height of said retaining tab, said channel being oriented so that it opens laterally toward said hanger with the untabbed leg of said channel positioned in the edge groove of at least one ceiling tile positioned adjacent to the apertured end of said hanger, while said channel and said ceiling tile are locked into position in proximity to said hanger.

2. The device described in claim 1 wherein said tabbed leg of said channel is shorter than its untabbed leg.

3. The device described in claim 1 wherein the height of said untabbed leg of said channel is substantially the same as the depth of the edge groove of the ceiling tile into which said leg is to be positioned.

4. The device described in claim 2 wherein the height of said untabbed leg of said channel is substantially the same as the depth of the edge groove of the ceiling tile into which said leg is to be positioned.

* * * * *